US005317984A

United States Patent [19]

Perrin et al.

[11] Patent Number: 5,317,984

[45] Date of Patent: Jun. 7, 1994

[54] FLEXIBLE BEARING FOR SUPPORTING THE MAINPIECE OF A RUDDER

[75] Inventors: Bernard Perrin, Mouchamps; Eric Perrot, Nantes; Robert Rigaudeau, La Gaubretiere; Didier Bourniquel; Marcel Guerry, both of Les Herbiers; Guy Charrier, Beaurepaire; André Kobus, Les Herbiers; Jean-Pierre Pilotto, La Roche S/ Yon; Patrice Crepaud; Jean-Baptiste Cassard, both of Les Herbiers; Yianis Mavrikios, La Gaubretiere, all of France

[73] Assignee: Jeanneau-Constructions Nautiques, Les Herbiers, France

[21] Appl. No.: 647,030

[22] Filed: Jan. 28, 1991

[30] Foreign Application Priority Data

Jan. 29, 1990 [FR] France ..... 90 00977

[51] Int. Cl.[5] ..... B63H 25/06

[52] U.S. Cl. ..... 114/169; 114/128; 114/162

[58] Field of Search ..... 114/127-129, 114/132, 140, 143, 144 R, 149, 162-169; 384/295, 280, 297; 277/188 R

[56] References Cited

U.S. PATENT DOCUMENTS

| | | | |
|---|---|---|---|
| 55,559 | 6/1866 | Van Deusen | 114/169 |
| 2,448,651 | 9/1948 | Aker | 114/169 |
| 4,809,631 | 3/1989 | Kramer | 114/169 |

FOREIGN PATENT DOCUMENTS

| | | | |
|---|---|---|---|
| 1018014 | 9/1977 | Canada | 114/169 |
| 5682699 | 7/1981 | China | 114/169 |

*Primary Examiner*—Robert J. Oberleitner
*Assistant Examiner*—Clifford T. Bartz
*Attorney, Agent, or Firm*—Jacobson, Price, Holman & Stern

[57] ABSTRACT

The flexible bearing is formed of a sleeve-shaped smooth bearing 6 fixed in a flexible block 4 nested in a housing 3 of the boat so as to absorb the bending deformations of the mainpiece without transmitting them to the structure. The housing 3 is streamlined so as to block the flexible block.

7 Claims, 2 Drawing Sheets

FLEXIBLE BEARING FOR SUPPORTING THE MAINPIECE OF A RUDDER

FIELD OF THE INVENTION

The invention, which relates to boat rudders, more specifically concerns the bearings supporting the rudder mainpiece, these bearings enabling the rudder blade to move in rotation whilst accomodating the bending deformations of this mainpiece when subjected to hydrodynamic forces.

BACKGROUND OF THE INVENTION

Generally speaking, the mainpiece of a rudder is supported by the boat by means of at least two bearings, that is either smooth bearings or ball bearings or needle bearings or even cylindrical roller bearings allowing the rudder blade to rotate.

Owing to the particular hydrodynamic forces possibly exerted transversally on the rudder blade, especially in difficult sea conditions, the mainpiece of the rudder may be subjected to bending deformations inducing an embedding force in these bearings which, when combined with a shearing force, strongly stresses the structure of the boat. These forces thus provoke a premature fatigue of the rudder mainpiece and the boat structure close to the bearings. Similarly, the induced deformations provoke premature wear of the mainpiece guides, this frequently requiring that the latter be replaced.

One conventional solution aiming to overcome these drawbacks consists of providing extremely solid, heavy and expensive mainpieces, mainpiece supports and a boat structure so as to avoid any ill-timed ruptures during navigation. Consequently, it is preferable to avoid implementing these solutions by using spherical rocker bearings or spherical ball bearings or barrel-shaped roller bearings. However, the drawback of these materials is the fact that they are extremely expensive, require constant maintenance to ensure correct functioning and are moreover extremely fragile, having regard to a marine environment.

Furthermore, the time involved in changing bearings in the event of the latter becoming worn or broken proves to be long and arduous as these elements need to be forcefully mounted, indeed often permanently cemented.

SUMMARY OF THE INVENTION

These drawbacks have induced the Applicant to invent a new flexible bearing system able to overcome the aforesaid drawbacks, particularly as regards reducing costs in terms of mounting and maintenance, whilst limiting the stresses undergone by the rudder mainpiece and generally thus improving boat safety during navigation.

One object of the present invention thus concerns a flexible bearing for the support of the mainpiece of a rudder enabling the rudder blade to rotate, said bearing being formed of a sleeve-shaped smooth bearing fixed in a flexible block nested in a housing of the boat so as to absorb the mainpiece bending deformations without transmitting them to the structure, the sleeve forming the smooth bearing being preferably made of a selected material so as to minimize the rotary friction of the mainpiece.

According to one particular characteristic of the invention, the flexible block has the shape of a crown secured to the smooth bearing and whose upper and lower faces are provided with a central annular throat favoring a certain crushing of the upper and lower edges of the crown.

Again, according to another characteristic of the invention, the internal profile of the housing receiving the flexible block has a conical shape or a prismatic shape with a slanted slope so as to favor blocking of said block.

BRIEF DESCRIPTION OF THE DRAWINGS

Other characteristics and advantages of the invention shall appear more readily from a reading of the following description of an embodiment example with reference to the accompanying drawings in which.

DETAILED DESCRIPTION OF THE PREFERRED EMBODIMENTS

Figure 1:
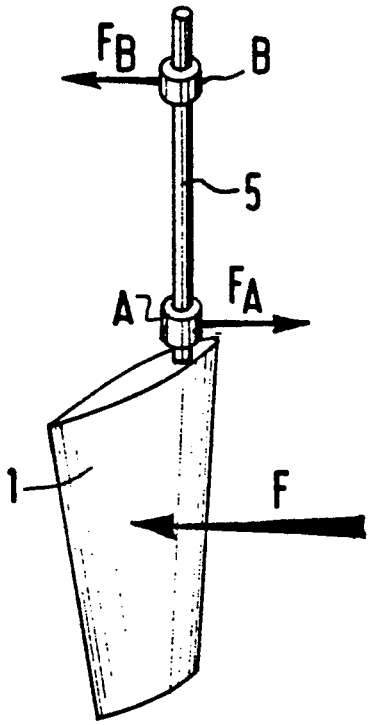
FIG. 1 is a perspective view of a rudder blade and its mainpiece.
Figure 2:
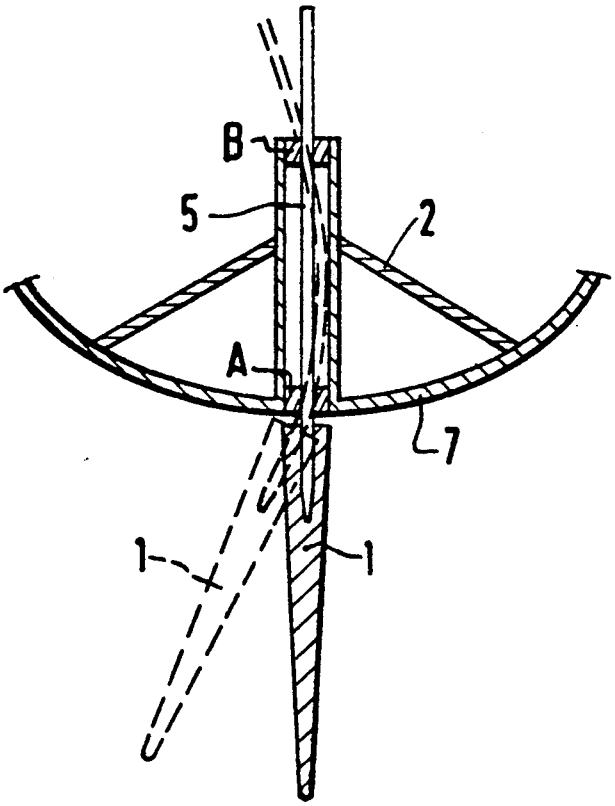
FIG. 2 is a profile view of the mainpiece mounted astern a boat.

FIGS. 1 and 2 show a rudder blade 1 and its mainpiece or shaft 5 traversing its framing and used to retain it on the structure 2 of the boat and ensure its rotation. Two bearings A and B are provided for this effect, the lower bearing A being anchored close to the bottom 7 of the boat and the upper bearing B being anchored slightly higher. FIG. 1 shows how during navigation it is possible to exert a transversal hydrodynamic force F whose resultants at the bearings are shown by the arrows FA and FB, obviously in an opposite direction. The full lines on FIG. 2 show the rudder blade 1 and its mainpiece 5 when they occupy a normal position and the dotted lines when the mainpiece has been subjected to a bending deformation (deliberately exaggerated on the drawing) under the action of lateral hydrodynamic forces. It is then advisable to stiffen the structure 2 of the boat close to the zone in question.

Figure 3:
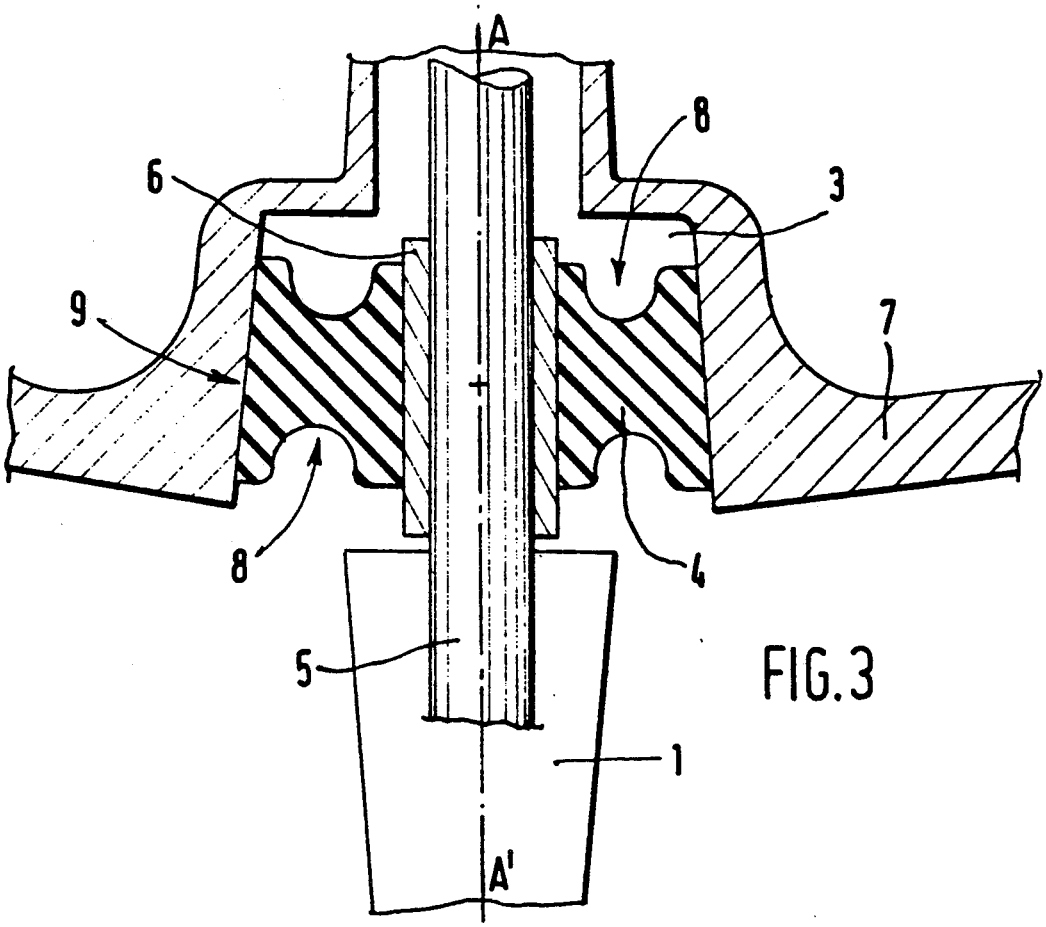
FIG. 3 is a large scale view of the flexible bearing in its normal position and FIG. 4 shows the view of FIG. 3 when the flexible bearing is in a deformed position.

FIG. 3 shows the mounting of a flexible bearing in a housing cavity 3 provided on the bottom of the hull of the boat. The mainpiece 5 supporting the rudder blade 1 is engaged in a sleeve-shaped smooth bearing 6 made of a selected material so as to minimize the rotary friction of the mainpiece. This bearing 6 is fixed in a block 4 made of a flexible material having a sufficient degree of flexibility so as to allow for a certain bending of the mainpiece. Advantageously, the block 4 has the shape of a crown and is secured to the smooth bearing and whose upper and lower faces are provided with a central annular throat 8 favoring a certain crushing of the upper and lower edges of the crown. The internal profile 9 of the housing cavity 3 has a conical shape or a prismatic shape with an inclined slope so as to be able to be nested and forcefully and easily block the flexible block 4, to ensure that its positioning is correct and that its subsequent dismounting is also rendered relatively simple.

Figure 4:
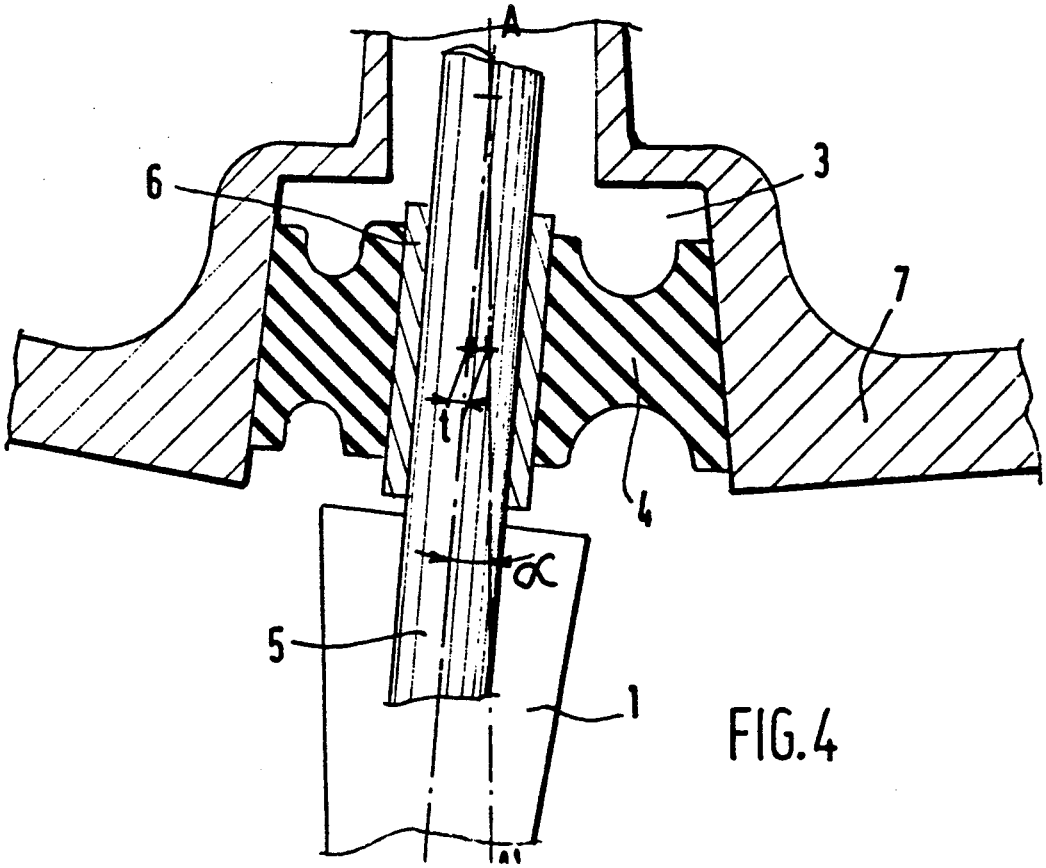

FIG. 4 shows a flexible bearing according to FIG. 3 and which is deformed with respect to the axis AA' of the mainpiece in its normal position. The bending deformation of the mainpiece 5 is indicated by the angle $\alpha$ between the bent mainpiece and the axis AA'.

The subsidence t resulting from the radial shearing forces exerted on the rudder blade 1 is expressed by a lateral deviation of the mainpiece with respect to its original position. The flexible block 4 is thus deformed and absorbs both the bending $\alpha$ and the subsidence t.

The hull of the boat thus no longer requires the reinforcement structure 2 shown on FIG. 2.

Another equivalent housing is also provided for the upper bearing, also equipped with a smooth bearing and a flexible block.

Apart from the advantages provided by these flexible bearings in all types of navigation conditions, they also make it possible to significantly cushion the abnormal forces exerted on the rudder blade and resulting, for example, from the impact of floating objects, rigging, nets, etc., and also significantly increase in improving the overall safety of the boat during navigation.

What is claimed is:

1. Flexible bearing for the support of the mainpiece of a rudder and enabling the rudder blade to rotate, wherein it is constituted by a smooth sleeve-shaped bearing fixed in a flexible block nested in a housing cavity of the boat so as to absorb the bending deformations of the mainpiece without transmitting them to the structure, said block having the shape of a crown secured to the smooth bearing and whose upper and lower faces are provided with a central annular throat favoring a certain crushing of the upper and lower edges of the crown.

2. A boat, said boat including rudder means incorporating a shaft and a blade supported from one end portion of said shaft, a pair of spaced apart rigid bearing means journaling axially spaced portions of said shaft at points spaced along the latter toward the other shaft end from said blade, a pair of spaced apart mounting means mounting said bearing means from said boat, each of said mounting means being flexible such to allow omni directional shifting thereof laterally of the static position of said bearing means and angular displacement of the corresponding bearing means about any axis normal to the last mentioned bearing means.

3. The boat and rudder means combination of claim 2 wherein said boat defines a prismatic shaped housing cavity through which said shaft extends, centrally, and in which the bearing means and mounting means therefor adjacent said blade are mounted, said housing cavity tapering away from said blade.

4. The boat and rudder means combination of claim 2 wherein said boat defines a conical shaped housing cavity through which said shaft extends, axially, and in which the bearing means and mounting means therefor adjacent said blade are mounted, said conical shaped housing cavity tapering away from said blade.

5. The boat and rudder combination of claim 2 wherein each of said mounting means includes a crown-shaped block of flexible material centrally through which the corresponding bearing means extends.

6. The boat and rudder means combination of claim 5 wherein each of said blocks includes opposite end faces facing axially in different directions along said shaft, each of said end faces having a central annular throat favoring a certain crushing of said end faces.

7. The boat and rudder means combination of claim 2 wherein said bearing means each comprise a smooth, sleeve-type bearing.

* * * * *